US006902519B2

(12) United States Patent
Öchsner et al.

(10) Patent No.: US 6,902,519 B2
(45) Date of Patent: Jun. 7, 2005

(54) FOLDING DEVICE

(75) Inventors: Rudolf Philipp Öchsner, Beindersheim (DE); Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/275,971

(22) PCT Filed: May 16, 2001

(86) PCT No.: PCT/DE01/01841

§ 371 (c)(1),
(2), (4) Date: Aug. 25, 2003

(87) PCT Pub. No.: WO01/87601

PCT Pub. Date: Nov. 22, 2001

(65) Prior Publication Data

US 2004/0053763 A1 Mar. 18, 2004

(30) Foreign Application Priority Data

May 17, 2000 (DE) ..... 100 24 328
Sep. 14, 2000 (DE) ..... 100 45 372

(51) Int. Cl.[7] ..... B31F 1/08

(52) U.S. Cl. ..... 493/428; 493/424; 493/432

(58) Field of Search ..... 493/424, 428, 493/432; 270/42, 7, 21.1

(56) References Cited

U.S. PATENT DOCUMENTS

| | | | | |
|---|---|---|---|---|
| 2,222,279 A | * | 11/1940 | Barber | 270/32 |
| 5,092,833 A | * | 3/1992 | King et al. | 493/424 |
| 5,386,979 A | | 2/1995 | Muller | |
| 5,425,697 A | | 6/1995 | Lanvin | |
| 5,901,647 A | | 5/1999 | Kohlmann | |
| 6,024,685 A | | 2/2000 | Kirsch | |

FOREIGN PATENT DOCUMENTS

| | | |
|---|---|---|
| DE | 1 960 565 | 6/1971 |
| DE | 25 37 920 | 3/1977 |
| DE | 76 06 107 | 8/1977 |
| DE | 42 08 353 A1 | 9/1993 |
| DE | 43 18 133 A1 | 1/1994 |
| DE | 44 07 375 A1 | 9/1995 |
| DE | 195 09 947 A1 | 9/1996 |
| DE | 195 25 169 A1 | 9/1996 |
| DE | 195 25 169 C2 | 2/2000 |
| EP | 0 729 910 A2 | 9/1996 |
| GB | 750749 | 6/1956 |
| GB | 1 325 024 | 8/1973 |

* cited by examiner

*Primary Examiner*—Sameh H. Tawfik
(74) *Attorney, Agent, or Firm*—Jones Tullar & Cooper, PC

(57) ABSTRACT

A folding device for use with a rotary printing press includes a folding-jaw cylinder and a folding blade cylinder. The folding blade cylinder is movable with respect to the folding-jaw cylinder between a working position where it cooperates with the folding-jaw cylinder and a rest position where it is moved away from the folding-jaw cylinder.

24 Claims, 9 Drawing Sheets

FOLDING DEVICE

FIELD OF THE INVENTION

The present invention is directed to a folding device of a rotary printing press. The folding device includes at least one folding jaw cylinder and one folding blade cylinder. An electric motor can be used to drive the pair of cylinders.

BACKGROUND OF THE INVENTION

Folding devices for a rotary printing press, which have a folding jaw cylinder and a folding cylinder working together with the folding jaw cylinder are known from DE 195 09 947 A1, as well as from DE 195 25 169 C2. In connection with these folding devices, it is disadvantageous that the product guidance is complicated. Thus, a signature arriving from a cutting groove cylinder must first be transferred to a folding jaw cylinder, and from there to a transverse folding cylinder before it reaches a belt guidance system, which conveys the product to a delivery device. The transverse folding cylinder of these folding devices must continuously run during production, even if it is not used for creating a transverse fold, since it is needed for conveying the signatures. Transfer or hand-over errors between the cylinders can lead to so-called "paper plugs", which can result in damage to the cylinders.

DE 43 18 133 A1 describes a folding device, which selectively creates products with a transverse fold in a first operating mode, and in a second operating mode, forms products with an additional second transverse fold. A first and second folding blade cylinder is arranged for this, wherein the signatures of the products of the second folding blade cylinder are selectively stripped off by means of belts.

DE 36 36 244 C2 discloses a folding device with a pivotable stapling cylinder, which selectively works together with a first or second folding jaw cylinder.

SUMMARY OF THE INVENTION

It is the object of the present invention to provide a folding device.

In accordance with the present invention, this object is attained by providing a folding device having at least one folding jaw cylinder and a folding blade cylinder that is working with it in a working position. The folding blade cylinder can be moved from a working position to a rest position. A second folding blade cylinder may also be provided. The first folding blade cylinder and the folding jaw cylinder can be mutually driven by one electric motor. The second folding blade cylinder is independently driven by a second electric motor.

The advantages to be attained by the present invention consist, in particular, in that damage to the folding device by paper plugs are prevented, and that the accessibility of the parts of the folding devices for maintenance purposes is simplified.

By shutting down cylinders which run unnecessarily, it is furthermore intended to achieve that the folding device becomes more energy-saving, wear resistant and quieter.

Because the displaceable cylinder is seated between two lateral elements, which can be pivoted against lateral frames of the folding device, a modular construction is made possible. The employment of a specifically assigned motor for driving the displaceable folding cylinder allows the decoupling of its movements from vibrations caused in the folding device by variably loaded other rotatably driven parts, such as a cutting and punching roller.

A further advantage of the specifically assigned motor is that, in a way different from a common drive of the folding cylinder and folding jaw cylinder by meshing, the phase position of the folding cylinder in respect to the folding jaw cylinder working together with it can be changed in a simple manner by a suitable control of this motor. Thus it is possible, in particular, to provide a coupling of the rotation of the motor to the width of the folding jaw gap in such a way that, with any width of the folding jaw gap, a folding blade of the folding cylinder enters the folding jaw gap centered. In this way, the folding device can be adapted very simply and rapidly to the processing of signatures of various thicknesses.

A further advantage lies in that the provision with a second transverse fold does not have any substantial effect on the design of the base unit of the folding device, i.e. that the otherwise customary bearing bores and the oil space required for the gear drive are omitted and do not require an increase in height of the frames of the folding device.

In accordance with a preferred embodiment, the folding device in accordance with the present invention furthermore has a folding cylinder that is seated fixed in place. In this case, the folding cylinder seated fixed in place can be used for creating a first transverse fold of the product, while the displaceably seated folding cylinder can be employed for creating a second transverse fold. While, for example, customarily a large portion of a printing of newspapers which are intended for delivery to subscribers or for street sale are produced with a single transverse fold, that portion of the printing intended for being sent by mail requires a second transverse fold in order to give the newspaper a format suitable for mailing. The folding device in accordance with the present invention permits the production of the newspaper with or without a second transverse fold, wherein the folding cylinder which can be displaced for the portion of the printing without a second transverse fold, can be pivoted into a position of rest and its drive mechanism can be shut off while the folding device is running.

In connection with a folding device with two folding cylinders, it is furthermore preferred that the folding jaw cylinder have pairs of folding jaws, wherein the second folding jaw of a pair works respectively together with another folding cylinder. This permits the simplification of the product guidance, because with such a structure, a signature can be picked up by the holding device of one of the two folding cylinders and the signature can be folded by pressing it into the gap of the first folding jaw with the aid of the folding blade of the folding cylinder and can be transferred to the folding jaw cylinder. Subsequently, the product folded in this way can be pushed by the folding blade of the other folding cylinder into the gap of the second folding jaw of the pair and in this way can be provided with a second transverse fold without it being necessary to transfer it to another cylinder. Therefore, the finished folded product can be transferred directly from the folding jaw cylinder to a belt guidance system or the like, and product conveyance is simplified in this way.

To make possible a center fold in connection with each product, even of different formats, the two gaps of the two pairs of folding jaw working together are usefully adjustable in respect to each other in the circumferential direction; the grippers in the folding cylinder are distributed in the same way.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
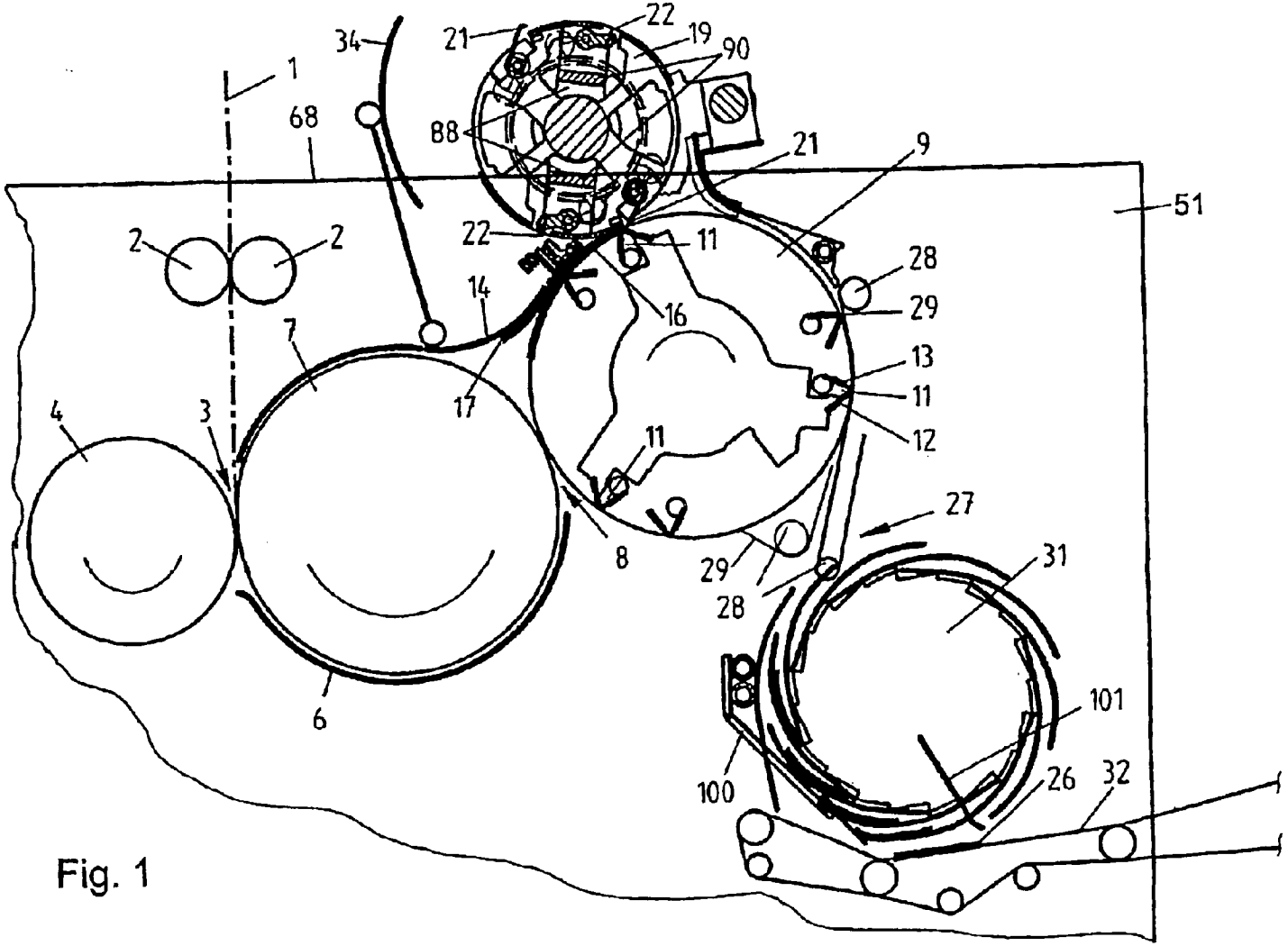
FIG. 1, a schematic section through a folding device in accordance with the present invention during a first phase of the folding process, FIG. 2, a partial section corresponding to that in FIG. 1 during a second phase of the folding process, FIG. 3, a partial section corresponding to FIG. 2 during a third phase of the folding process, FIG. 4, a portion of the folding device with a folding cylinder displaced into a passive position, FIG. 5, a guide or pressure element, FIG. 6, a gripper regulating device, or folding jaw regulating device in axial section, FIG. 7, a partial lateral view of the folding device, FIG. 8, a schematized representation of the drive mechanism of the displaceable folding cylinder, FIG. 9, a further development of the folding device in partial section corresponding to FIG. 4.

A schematic section through a folding device of a rotary printing press, in accordance with the present invention, is represented in FIG. 1. A web 1, or a strand consisting of a plurality of webs, coming out of a former (not represented) and entering the folding device, first passes over a pair of traction rollers 2 and thereafter reaches a first gap 3 between a cutting cylinder 4 and a first folding blade cylinder 7, which is seated fixed in place. On its circumference, the cutting cylinder has blades which act together with blade grooves of the first folding blade cylinder 7 and cut the web 1 into individual signatures. The individual signatures are grasped by a holding device of the first folding blade cylinder 7, such as a gripper or point needles, and in this way the signature is conducted in a counterclockwise direction in the drawing figure between the first folding blade cylinder 7 and a lower region of a first guide plate 6 extending around the first folding blade cylinder 7.

The first guide plate 6 terminates in the vicinity of a second gap 8 between the first folding blade cylinder 7 and a folding jaw cylinder 9. On its circumference, this folding jaw cylinder 9 has a number of first folding jaws 11, which are evenly spaced apart from each other in the circumferential direction. In the example represented in FIG. 1, the folding jaw cylinder 9 has three first folding jaw pairs 11 at an angular distance of 120°. The distance between two first folding jaw pairs 11, measured on the circumference of the folding jaw cylinder 9, corresponds to the length of a not yet folded signature. Each of the first folding jaw pairs 11 has a strip-shaped cheek or jaw 12, fixed in place on the folding jaw cylinder 9, and a pivotable cheek or jaw 13 coupled with the rotary motion of the folding jaw cylinder 9. The coupling of the movement of the pivotable cheek or jaw 13 to the rotation of the folding jaw cylinder 9 takes place with the aid of a cam plate, not represented in FIG. 1. The latter opens the gap of the first folding jaw pair 11 shortly before it reaches the gap 8, so that a folding blade mounted on the first folding blade cylinder 7 can press the signature carried along by the first folding blade cylinder 7 into the gap of the first folding jaw pair 11 during the passage through the gap of the first folding jaw pair 11. A first center transverse fold is created in the signature in this way. While, after passage through the gap 8, the folding blade of the first folding blade cylinder 7 is retracted, the cheeks or jaws 12, 13 of the first folding jaw pair 11 close, so that the signature remains stuck in the first folding jaw pair 11 and in this way is taken over by the folding jaw cylinder 9 and is conveyed on.

To this point, the mode of operation of the folding device corresponds to that of conventional folding devices, for which reason a detailed representation of the cutting cylinder 4 and the first folding blade cylinder 7 has been omitted, also in FIG. 1.

A second guide plate 14 closes the outlet nip of the second gap 8. It is used to fold over the front half of the signature released from the holding device of the first folding blade cylinder 7, so that the signature, with the fold leading, is conveyed on by the folding jaw cylinder 9. FIG. 1 shows a signature identified by 16 in this stage of processing, wherein the formerly leading part 17 of the signature 16 brushes along the second guide plate 14.

Figure 2:
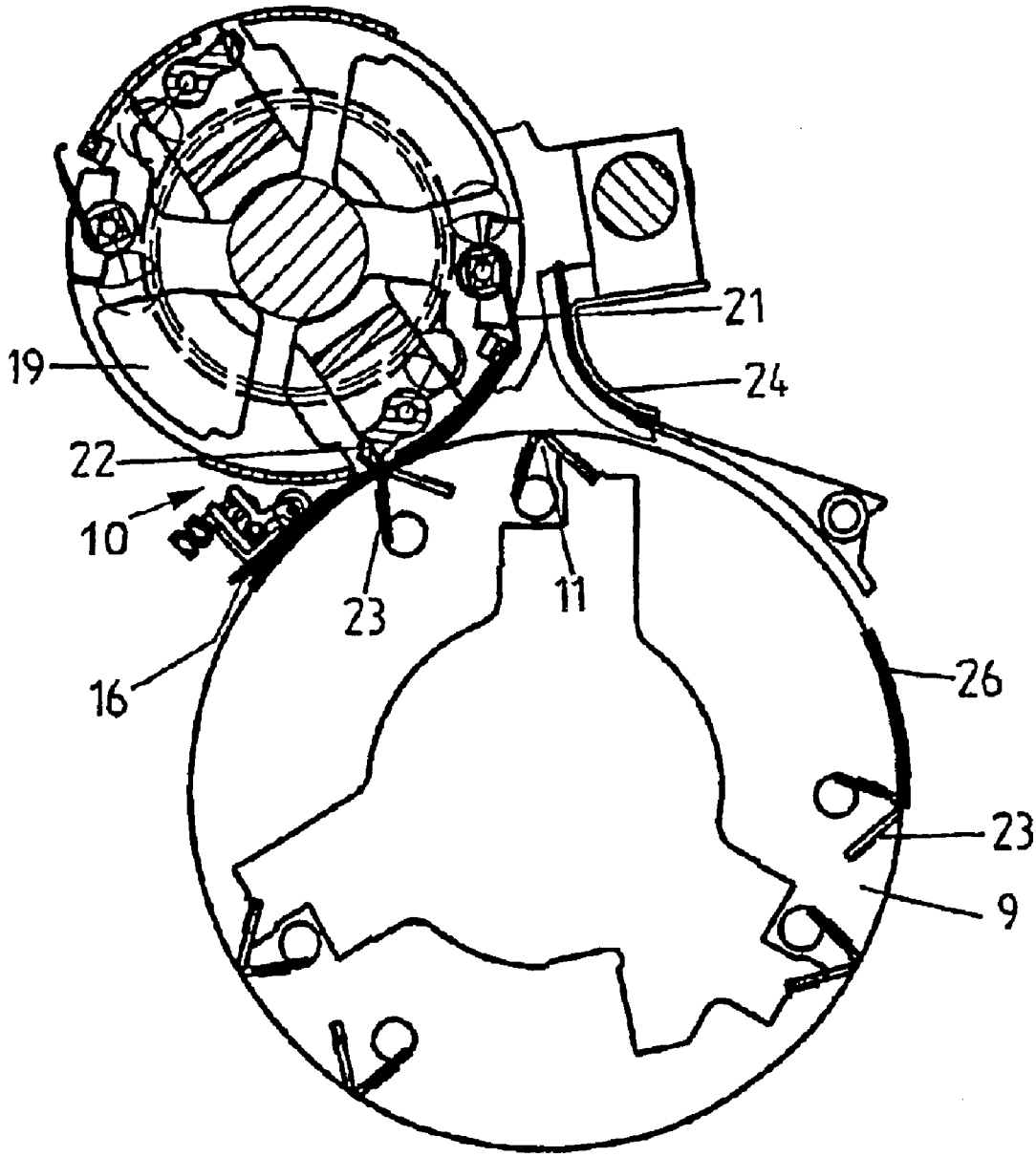

A guide or contact element 18 follows the second guide plate 14, and its construction will be shown in greater detail in FIG. 5 and will be described at a later time. This guide or contact element 18 is located in the entry nip of a third gap 10, which is defined between the folding jaw cylinder 9 and a second folding blade cylinder 19, as seen in FIG. 2. On its circumference, this second folding blade cylinder 19 supports two holding devices placed diametrically opposite each other, in this case in the form of grippers 21. Since the number of the grippers 21, or of the folding blades 22, is less than that of the first folding jaws 11, the diameter of the second folding blade cylinder 19 is also comparatively less than that of the folding jaw cylinder 9. This makes the arrangement of the two folding blade cylinders 7, 19, and of a belt guidance system, on the circumference of the folding jaw cylinder 9, described later, easier.

In the phase of the folding process represented in FIG. 1, one of these grippers 21 is just in the process of taking over the signature 16 in the area of its first transverse fold from the opening first folding jaw pair 11. The second folding blade cylinder 19 furthermore has two folding blades 22. The distance between the gripper 21 and the following folding blade 22 on the second folding blade cylinder 19 can be adjusted and is advantageously set to a quarter of the length of the signature 16 in order to place a second transverse fold centered into the already once transversely folded signature by use of the folding blade 22.

On its circumference, this second folding blade cylinder 19 can have a plurality of holding devices, which are located at identical distances from each other, in this case in the form of grippers 21 and two in number. The folding blades are also placed in the same way as the holding devices, spaced apart from the holding devices at the same distance corresponding to the length of the format. The fewer the number of holding devices, or folding blades, the smaller the structure of the second folding blade cylinder can be. In the most simple case, one holding device and one folding blade can also be provided.

The phase of forming the second transverse fold is represented in FIG. 2 by use of a partial section. In this phase, the first transverse fold of the signature 16 is lifted off the surface of the folding jaw cylinder 9 by the gripper 21; the first folding jaw pair 11 is empty and open. A second folding jaw pair 23 is arranged on the circumference of the folding jaw cylinder 9 at a distance from the first folding jaw pair 11 corresponding to the distance between the gripper 21 and the folding blade 22 on the second folding blade cylinder 19. The spacing between the first and second folding jaw pairs 11, or 23, is also adjustable.

The folding blade 22 pushes the signature 16 into the open gap of the folding jaw pair 23, and the signature 16 is clamped in the gap. At the same time the gripper 21 releases the first transverse fold of the signature 16.

Figure 3:
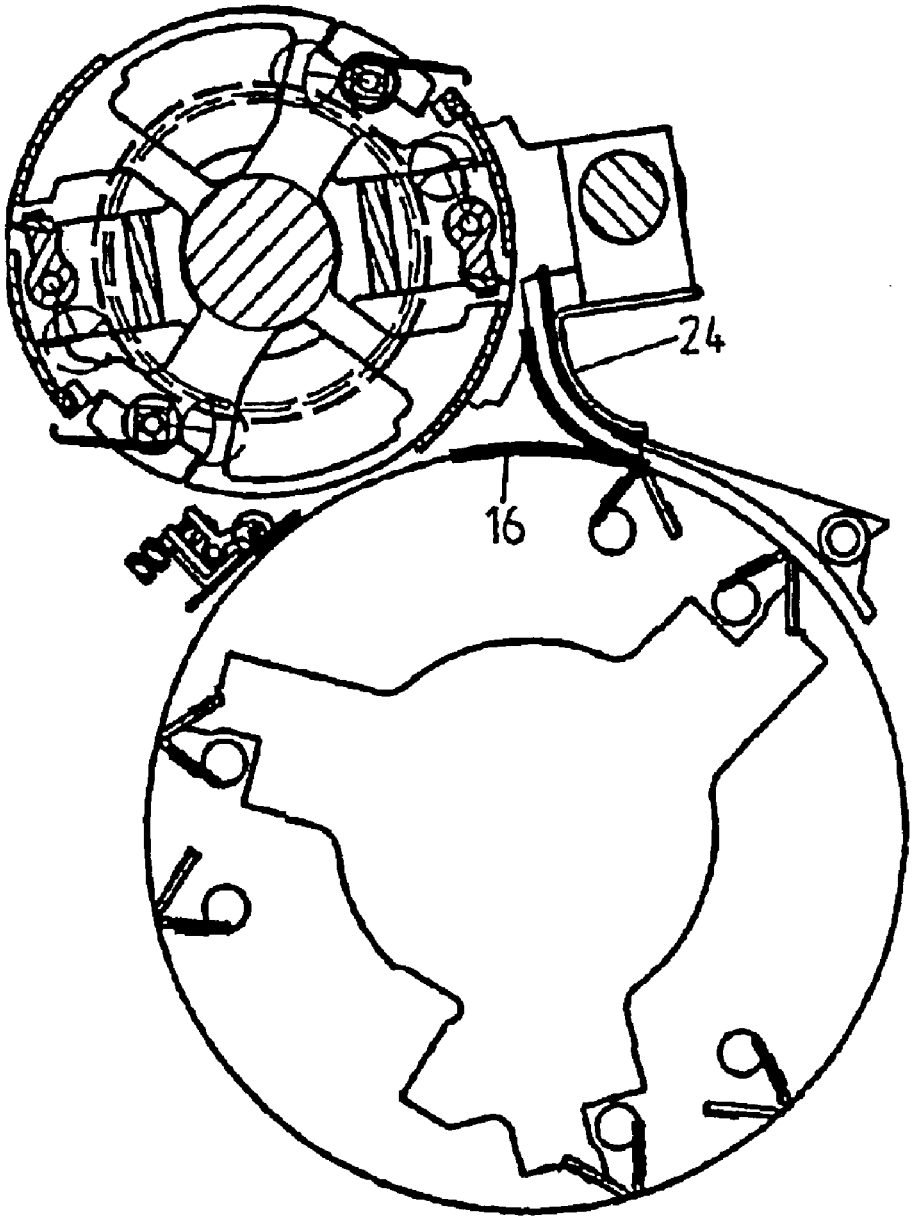

Guide brushes 24 are arranged in the outlet nip of the gap between the second folding blade cylinder 19 and the folding jaw pair 9. As can be seen in FIG. 3, they are used to pivot the two legs of the now twice transversely folded signature 16 against the surface of the folding jaw cylinder 9 and thus to complete the folding process. The twice folded product 26, finished after the passage between the guide brushes 24 and the folding jaw cylinder 9, can be seen in FIG. 2.

A belt guidance system 27, schematically represented in FIG. 1, with belts 29 guided around rollers 28, takes over twice folded the product 26, which is released in the approximate position represented in FIG. 2 from the second folding jaw 23, and conducts it to a bucket wheel 31, which in the customary manner places the product 26 overlappingly on a belt delivery device 32, wherein the guide tongues 100 are pivoted toward the detent 101 at a distance approximately corresponding to the length of the twice folded product 26.

Figure 4:
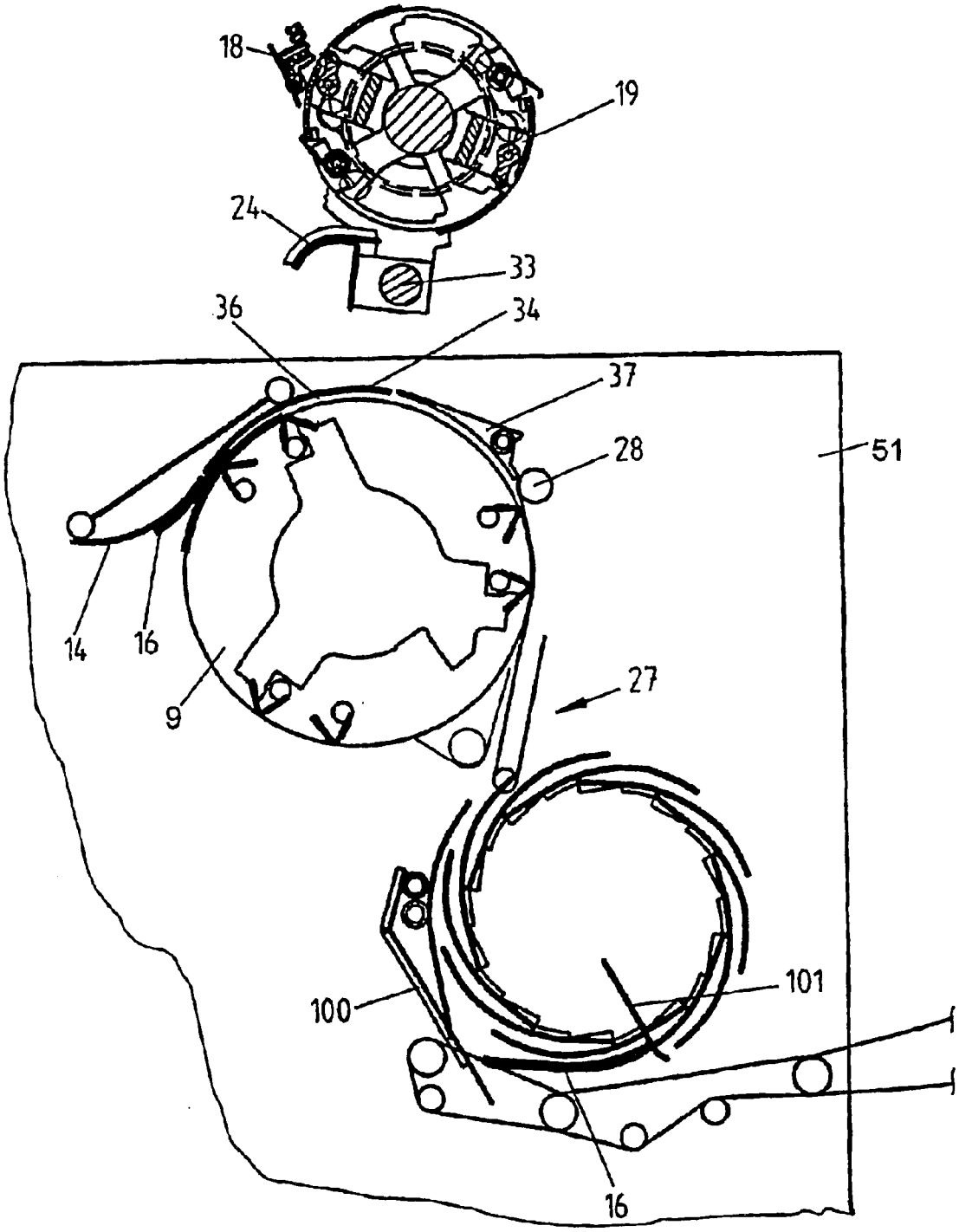

Together with the guide or contact element 18 and the guide brushes 24, the second folding blade cylinder 19 constitutes a modular unit, which can be displaced from a working position of the second folding blade cylinder 19, represented in FIGS. 1 to 3, into a passive position represented in FIG. 4. In this passive position, the second folding blade cylinder 19 has been pivoted at an angle of approximately 105° around a shaft 33 in respect to the working position, in its place a third guide plate 34 has been pivoted up against the folding blade cylinder 9 and in this way constitutes a continuous guide gap 36 for the signature 16, which extends substantially without interruption from the second guide plate 14 to a guide body 37 and further as far as the first roller 28 of the belt guidance system 27. In this way, the third guide plate 34 prevents the freshly folded signature 16 from unfolding again during its travel from the end of the second guide plate 14 to the tip of the guide body 37 when the second folding blade cylinder 19 is in its passive position. The guide tongues 100 are pivoted away from the detent 101 at a distance approximately corresponding to the length of the product 26.

In this way, it is possible, by simple pivoting of the component consisting of the guide or contact element 18, the second folding blades 19 and the guide brushes 24, to switch between a production with single or with double transverse folds. Since the second folding blade cylinder 19 no longer has a conveying function in the production of a single transverse fold, its drive mechanism can be switched into the passive mode, even if the folding device is operated.

Figure 5:
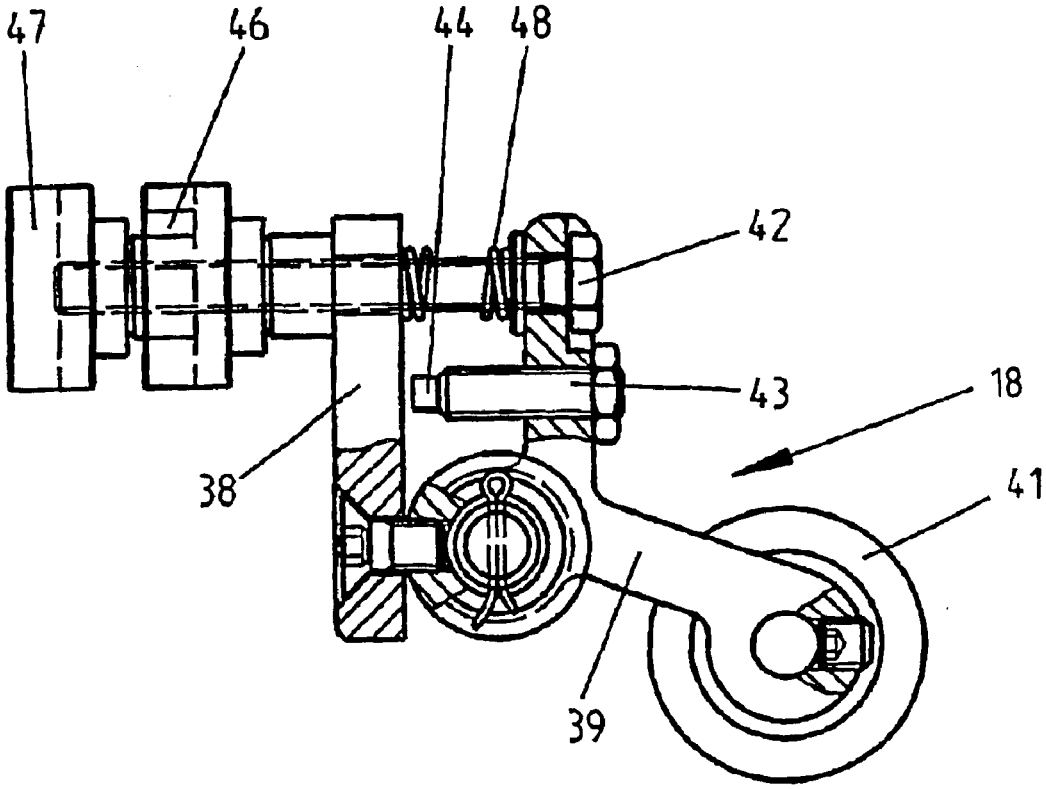
Figure 7:
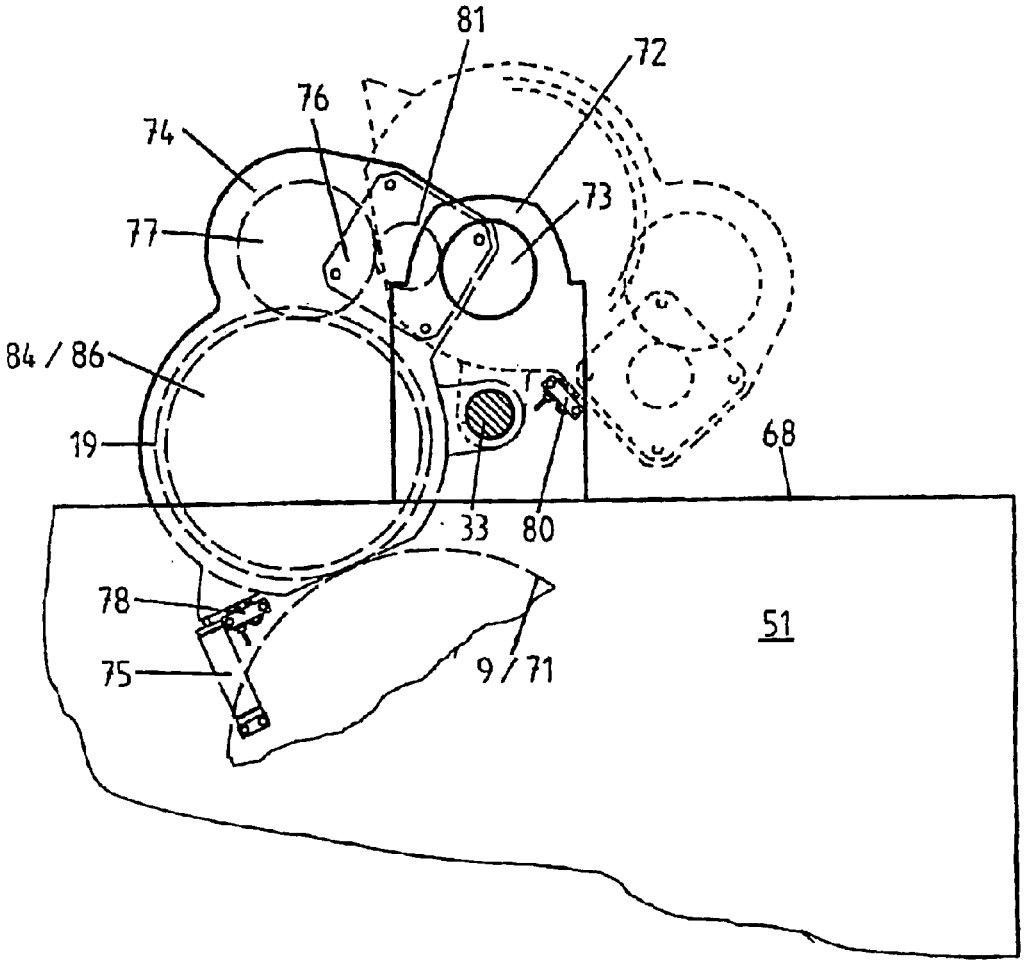

FIG. 5 shows in detail the structure of the guide or contact element 18. It is comprised of a carrier 38, which is fixedly connected with a not specifically represented lateral element 74 as seen in FIG. 7, which simultaneously constitutes a holder for the shaft 33 of the second folding blade cylinder 19 and supports the guide brushes 24. A pivot arm 39 hinged on the carrier 38 supports on one end a rotatable roller 41 and on the other end two bores for a screw 42 and a threaded pin 43. The threaded pin 43 can be axially adjusted and has a tip 44 located opposite the carrier 38. This tip 44 constitutes a detent, which limits a pivot movement of the roller 41 in a counterclockwise direction. The screw 42 extends through a bore of the carrier 38 and on its distal end has two knurled nuts 46, 47, of which the one knurled nut 46 is used for setting the pivotal freedom of movement of the roller 41, and the other knurled nut 47 is used for checking the first knurled nut 46. A spring 48, for example a helical spring 48, exerts a torque in a clockwise direction on the pivot arm 39.

The setting of the threaded pin 43 defines the maximum distance over which the roller 41 can be spaced from the folding jaw cylinder 9 by pivoting the pivot arm 39 in the course of a passage of a signature 16 between the roller and the folding jaw cylinder. Usefully, this maximum distance has been set to a value which corresponds to the expected maximum thickness of the singly transversely folded signature 16, plus a slight play. If, in the case of a paper plug, the thickness of the signature 16 is greater and the roller 41 is pushed upward past the amount predefined by the threaded pin 43, the entire component is pivoted by this from the working position upward, and damage to the sensitive movable parts of the folding jaw cylinder 9 and the second folding blade cylinder 19 is prevented.

It is alternatively possible to also provide a servo mechanism, which measures the force transferred from the roller 41 to the carrier 38 and which, when a threshold value is exceeded, drives an actuating member for pivoting the second folding blade cylinder 19 out of its working position.

As FIG. 7 shows, the pivoting in and out of the folding blade cylinder 19 can also be caused by use of an electric motor 73, which acts on the shaft 33 and, by means of an electrical standstill moment against a gas pressure spring 75, keeps the folding blade 19 down in the working position, and in case of an overload because of a paper backup, the pivoting away can be triggered by a limitation of the moment.

In case of an electrical outage, the gas pressure spring 75 takes on the function of the lift off by itself in order to achieve a safe distance between the folding jaw cylinder 9 and the folding blade cylinder 19, which protects the grippers 21 and folding blades 22, even at the time of spinning down of the electric motor. Up to the time of spinning down, the synchronous braking is fed by the remaining voltage from the intermediate circuit.

It is a second object of the guide or contact element 18 to assure a low-friction guide of the signature 16. Because of its ability to rotate, the roller 41 exerts a substantially reduced friction on a passing signature 16 than would be the case with an immovable guide plate, such as the second guide plate 14. Therefore, at the moment of the transfer of the first transverse fold to the gripper 21 of the second folding blade cylinder 19, at best only small braking frictional forces act on the signature 16, which simplifies the transfer and improves accuracy.

Figure 6:
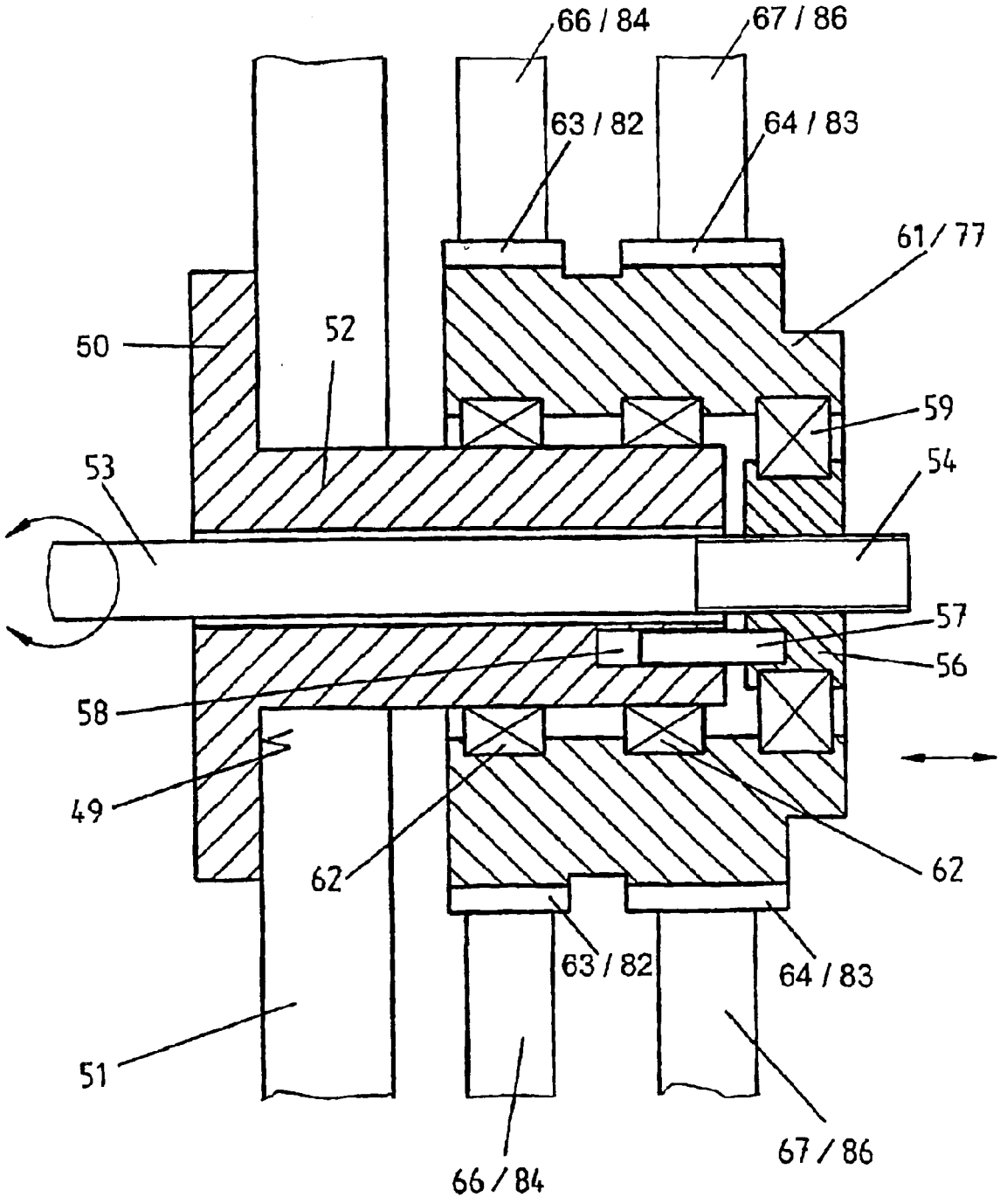

As already mentioned, the mutual distance between the first and second folding jaw pairs 11, 23 of the folding jaw cylinder 9, and of the grippers 21 and the folding blades 22 of the second folding blade cylinder 19, can be adjusted. FIG. 6 shows in schematic section a structure of a rotatable suspension, by use of which such an adjustment can be controlled. The structure is described here with respect to the folding jaw cylinder 9, but can be applied to the second folding blade cylinder 19. The suspension is comprised of a flange 50, which is fastened by one of its front faces, in this case the inner front face 49, on a lateral frame 51 of the folding device. A cylindrical extension 52 projects through an opening of the lateral frame 51 into the interior of the folding device; a spindle 53 is guided in an axial bore of the extension 52. On its end pointing into the interior of the folding device, the spindle 53 has a screw thread 54 on which a nut 56 is seated. A torsion prevention pin 57, which is rigidly connected with the nut 56, engages a blind bore 58 of the extension 52. By use of this, the nut 56 is held fixed against relative rotation, but can be moved back and forth by rotating the spindle 53.

On its exterior circumference, the nut 56 has a bearing 59, for example a deep groove ball bearing 59. Axial regulating forces can be transferred from the nut 56 to a rotatable regulating drum 61, 77 via the deep groove ball bearing 59. The regulating drum 61, 77 is furthermore supported by an axially displaceable bearing 62, for example a needle bearing, on the exterior circumference of the extension 52. On its exterior circumference, the regulating drum 61, 77 has two helical gearings 63, 64, 82, 83, each with different helix angles. The two helical gearings 63, 64, 82, 83 mesh with two crown gears 66, 67, 84, 86, of which one crown gear 67, 86 supports the surface shell of the folding jaw cylinder 9, as well as the first folding jaws 11, which are fixedly connected with the shell surface, the other crown gear 66, 84 is connected with the adjustable second folding jaws 23.

A rotation of the spindle 53 causes an axial displacement of the regulating drum 61, 77 and, along with it, a turning of the two crown gears 66, 67, 84, 86 in relation to each other, depending on the helix angles of the helical gearings 63, 64, 82, 83. The length of the turning is a function of the difference between the helix angles, as well as the diameter of the folding jaw cylinder 9. A length of a few centimeters in respect to the circumference of the folding jaw cylinder 9 is fully sufficient for most practical applications.

To achieve the radian measure between the folding jaw pairs 11 and 23, and the one between the grippers 21 and the folding blade 22, simultaneously and at the correct ratio, each of the two displacement devices in FIG. 6, which are engaging the folding jaw cylinder 9 and the folding blade cylinder 19 with teeth, is equipped with a regulating drive, which acts on the spindle 53.

An adjustable detent 78, 80, as seen in FIG. 7, each is attached at two positions remote from the shaft 33 on the lateral frame 51. While the contact of the lateral element 74 with the detent 78 activates the working position of the second folding blade cylinder 19, the contact of the lateral element 74 with the detent 80 triggers the position of rest of the second folding blade cylinder 19.

The position of the second folding blade cylinder 19 in relation to the folding jaw cylinder 9 can be set in the working position regardless of the regulating accuracy of the electric motor 73, or of the reduction gear, with the aid of the detent 78.

The detents 78 and 80 furthermore contain an initiator, or switch, which upon contact with the lateral element 74 triggers a stop of the electric motor 73 and releases other drive motors of the folding device again, including the second electric motor 76.

A contactless state of the lateral element 74 with the detents 78 and 80 triggers, besides the electric motor 73, a stop of all drive motors in the folding device, including the second electric motor 76.

As also described, in the working position of the second folding blade cylinder 19, the electric motor 73 exerts a pressure via a predetermined standstill moment on the detent 78, as well as on the gas pressure spring 75, which is therefore compressed and represents a counter-force. If thereafter the pressure between the two cylinders 9 and 10 becomes too great because of a paper backup and the danger of damage to the press arises, the standstill moment on the electric motor 73 is overcome, the electric motor 73 is then set into operation and lifts the second folding blade cylinder 19 upward out of the work area via the gear and with the aid of the gas pressure spring 75. All motors of the folding device, including the second electric motor 76, are stopped.

FIG. 7 shows a schematic lateral view of a portion of the folding device. An upper edge 68 of the lateral frame 51 of the folding device can be seen. The cutting cylinder 4, the first folding blade cylinder 7, the folding jaw cylinder 9, the belt guidance system 27 and the bucket wheel 31 are arranged between the lateral frame 51 and an oppositely located lateral frame, not represented. The circumference of the folding jaw cylinder 9, which is hidden by the lateral frame 51 in FIG. 7, is indicated by a dashed line 71. A housing 72 with an electric motor 73 is mounted on the lateral frame upper edge 68. The housing 72 contains, for example, a reduction gear for transferring the drive force of the electric motor 73 to the shaft 33 so that, as already explained, the second folding blade cylinder 19 can be pivoted out of its working position into a passive position. The second folding blade cylinder 19 is rotatably seated between two lateral element 74, one of which is visible in the drawing figure. Actually, in the working position the lateral element is represented by a solid outline, and in the passive position by a dashed outline; the shaft 33 is fixedly connected with both lateral elements 74. A second electric motor 76, indicated by a dashed outline, is mounted on the side of the lateral element 74 facing away from the viewer, which drives the second folding blade cylinder 19 in a rotating manner by means of a pinion gear 81 via a regulating drum 61, 77, also indicated by dashed lines. Moreover, the guide or contact element 18 and the guide brushes 24 are mounted between the two lateral elements 74.

Together, the elements 74, 76, 77, 78, 18, 19 and 24, together with the housing 72 and the electric motor 73, constitute an independent module which, when not used, can be removed from the folding device. This modular construction also permits the building of simple and cost-efficient folding devices which lack the module, but which are equipped for the retroactive mounting of such a module. This makes it possible for a print shop to keep the investment for a folding device low as long as there is no requirement for products with double transverse folds; but if such a requirement arises, the folding device can be made suitable in a cost-efficient and simple and space-saving manner for the production with double transverse folds by purchasing the module.

A control circuit, not specifically represented, controls the rotary movement of the second electric motor 76, and therefore that of the second folding blade cylinder 19, exactly synchronous with the rotary movement of the folding jaw cylinder 9. In this case, the relative phase position of the folding jaw cylinder 9 and of the second folding blade cylinder 19 are regulated, taking into consideration the gap width set at the second folding jaw pairs 23 for receiving the signature 16, so that it is assured that a folding blade 22 of the second folding blade cylinder 19 always enters centered in an associated folding jaw gap.

Figure 8:
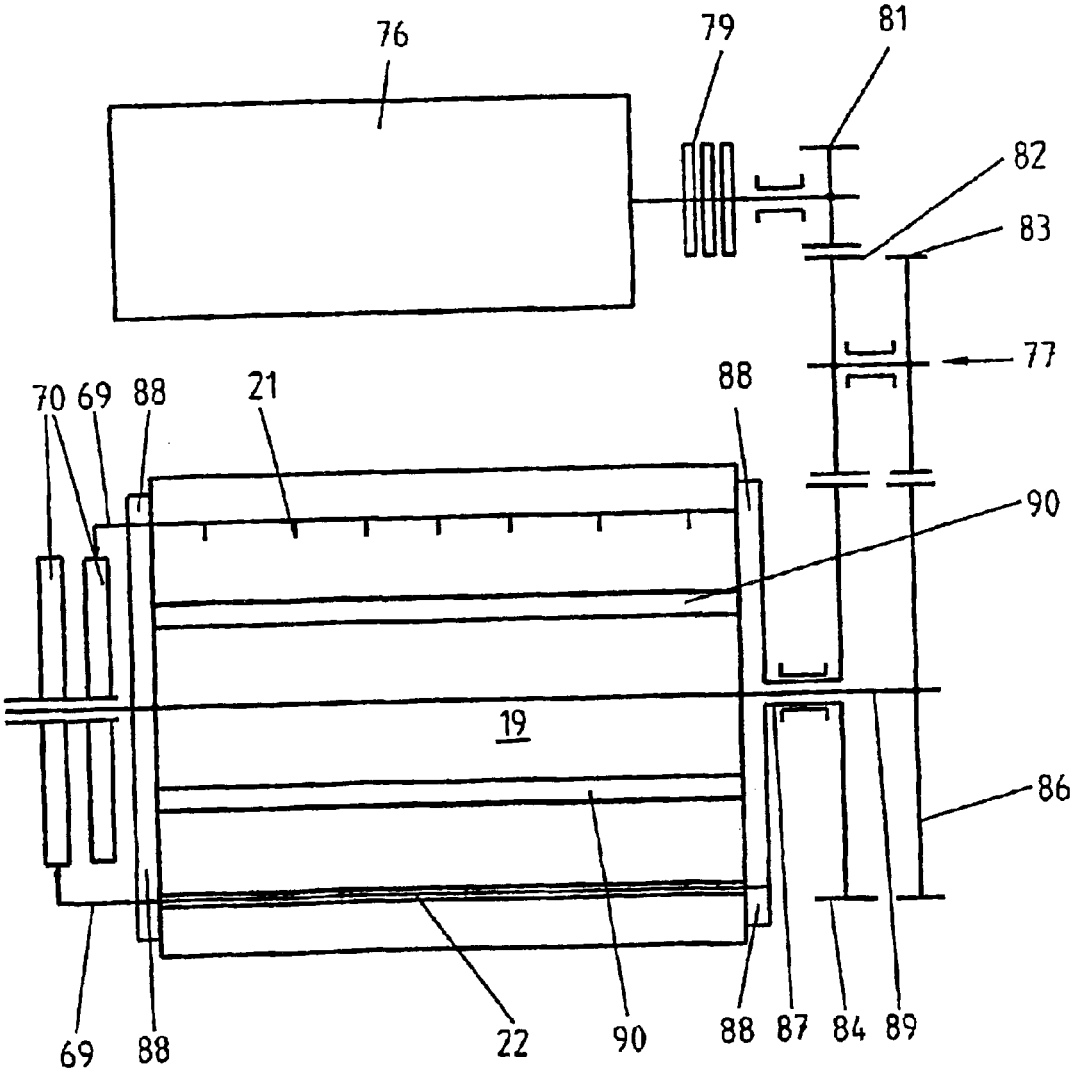

FIG. 8 shows, greatly schematized, the drive mechanism of the second folding blade cylinder 19. The second electric motor 76 drives a pinion gear 81 via a coupling 79, which is used to shield the second electric motor from irregularities in the rotary movement of the downstream-arranged gear. This gear includes, besides the pinion gear 81, the regulating drum 61, 77 driven by it, which had already been mentioned in respect to FIG. 7. As can be seen in FIG. 8, this regulating drum 61, 77 has two helical gearings 63, 64, 82, 83, of which only one helical gearing 82 meshes with the pinion gear 81. The construction of the regulating drum 61, 77 corresponds to the construction described in connection with FIG. 6: the gearings 82, 83 are helical gearings with different helix angles than those of the helical gearings 63, 64, and they are axially displaceable by use of a mechanism which can be driven with the aid of a rotary spindle. An angular offset between the two gear wheels 84, 86 driven by the helical gearings 82, 83 can be adjusted by that axial displacement. The gear wheel 84 drives the rotary movement of the folding blades 22 via a hollow shaft 87 and two arms 88, more clearly visible in FIG. 1, which are connected with each other in the axial direction by cross pieces 90; the gear wheel 86 drives the rotation of the shell surface of the second folding blade cylinder 19, as well as the grippers 21, via a shaft 89 passed through the hollow shaft 87.

The drawing figure of FIG. 8 furthermore schematically shows pivot arms 69, which are each connected with one of the respective folding blades 22, or grippers 21, and which roll off on a cam disk 70, fixedly connected with one of the lateral elements 74, and in this way assure an opening and closing movement of the gripper 21, or a pivoting-out movement of the folding blade 21 coupled to the respective rotary position of the second folding blade cylinder 19.

Coupled electric motors can be provided for the respective rotary drive of the spindle 53 on the folding jaw cylinder 9, as well as the functionally equivalent spindle of the regulating drum 61, 77, wherein it is assured by use of the coupling that the distances between the first and second folding jaw pairs 11, 23 on the one hand, and between the grippers 21 and folding blades 22 on the other hand are always varied in the identical way.

Figure 9:
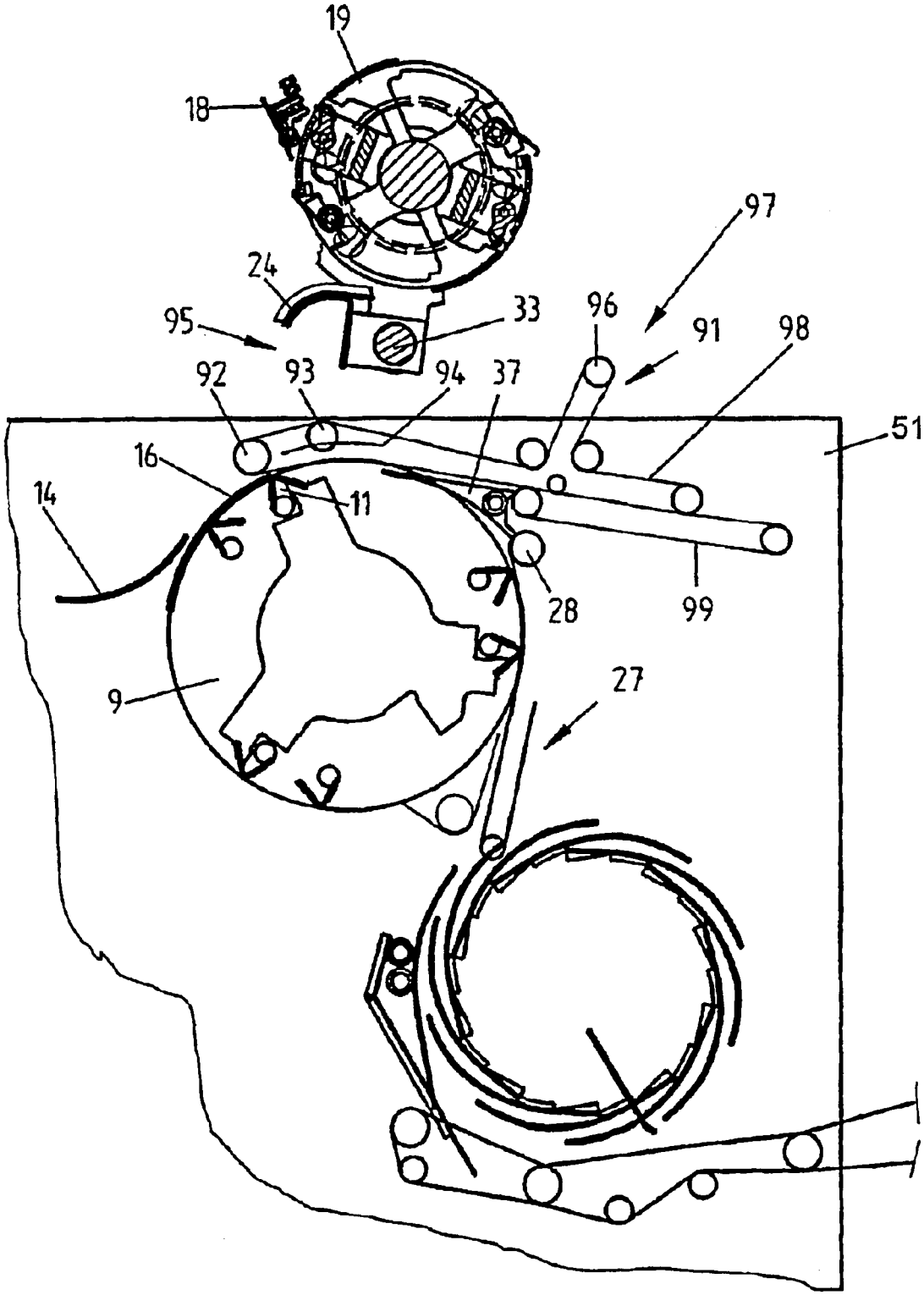

FIG. 9 shows a further embodiment of the folding device in partial section analogous to the one in FIG. 4. Components which had already been described in respect to FIGS. 1 to 8 here have the same reference symbols and will not be described again. In FIG. 9 the second folding blade cylinder 19 is in the passive position, in which a wide space exists between it and the folding jaw cylinder 9. A belt guidance system 91 has two movable rollers 92, 93 which, when the second folding blade cylinder 19 is in the working position, are in an inactive, not represented position, behind the guide brushes 24 and which are coupled to the position of the second folding blade cylinder 19 in such a way that, when the second folding blade cylinder 19 is pivoted into its passive position, they advance opposite the conveying direction of the signature 16 on the folding jaw cylinder 9 in the direction of the arrow 94 into the positions represented in FIG. 9. A further roller 96 of the belt guidance system 91 can be displaced transversely to the general orientation of the belt guidance system 91 in the direction of the arrow 97 against a spring force in order to maintain the belt 98 guided by the rollers 92, 93 tightly stretched regardless of the position of the rollers 92, 93. In the position of the belt guidance system 91 indicated in FIG. 9, this belt 98 touches the circumference of the folding jaw cylinder 9, on that portion of its circumference, where the first folding jaw pairs 11 open for releasing the signature 16 guided from the inside. The guide body 37 is pivotably suspended and touches the surface of the folding jaw cylinder 9 under the pressure from the belt 98. The signature 16 released from the first folding jaw 11 is lifted off the folding jaw cylinder 9 in this way and is conveyed on between the guide body 37 and the belt 98. A second belt 99 of the belt guidance system 91 adjoins the end of the guide body 37 which is at the rear in the conveyance direction. The signature 16 is conveyed between the two belts 98, 99 to the inlet of a folding device, not specifically represented for forming a second longitudinal fold. In this way, the embodiment in accordance with FIG. 9 selectively allows, depending on the position of the second folding blade cylinder 19, the formation of a second transverse fold or of a second longitudinal fold in the product 26.

A further development, which is not represented in a separate drawing figure, comprises the pivotable third guide plate 34 from FIG. 4, as well as the belt guidance system 91 from FIG. 9. With this structure, the movement of the rollers 92, 93 is coupled to the pivot movement of the folding blade cylinder 19, as well as to the movement of the third guide plate 34. This coupling achieves that, when the folding blade cylinder 19 is in its passive position, either the guide plate 34 can be folded against the folding jaw cylinder 9, as represented in FIG. 4, or the belt guidance system 91 enters into the intermediate space 95. With this structure, the selective production with simple transverse folds, with double transverse folds, or with a single transverse and a second longitudinal fold is therefore possible.

While preferred embodiments of a folding device in accordance with the present invention have been set forth fully and completely hereinabove, it will be apparent to one of skill in the art that changes, in, for example, the specific printing press used, the specific structure of the grippers and the like could be made without departing from the true spirit and scope of the present invention which is accordingly to be limited only by the following claims.

What is claimed is:

1. A folding blade apparatus comprising:

at least one folding jaw cylinder;

a first folding blade cylinder adapted to work with said folding jaw cylinder in a first working position defined by said first folding blade cylinder and said folding jaw cylinder;

a second folding blade cylinder adapted to work with said folding jaw cylinder in a second working position defined by said second folding blade cylinder and said folding jaw cylinder;

means for displacing said second folding blade cylinder between said second working position and a rest position, said second folding blade cylinder being moved away from said folding jaw cylinder in said rest position; and at least first and second pairs of folding jaws on said folding jaw cylinder, said first folding blade cylinder working with said first pair of folding jaws and said second folding blade cylinder working with said second pair of folding jaws when said second folding blade cylinder is in said second working position.

2. The folding apparatus of claim 1 wherein said means for displacing said second folding blade cylinder includes plugs positionable between said second folding blade cylinder and said at least one folding jaw cylinder.

3. The folding apparatus of claim 1 further including a belt guidance system adapted to take signatures from said at least one folding jaw cylinder, said belt guidance system being positionable between said at least one folding jaw cylinder and said second folding blade cylinder in said rest position.

4. The folding apparatus of claim 1 further including means for mechanically displacing said second folding blade cylinder out of said working position in response to a voltage drop.

5. The folding apparatus of claim 1 further including drive motors in the folding apparatus, said drive motors acting as generators in response to a voltage drop and driving said first and second folding blade cylinders synchronously with said at least one folding jaw cylinder.

6. A folding apparatus comprising:

at least one folding jaw cylinder;

a folding blade cylinder adapted to work together with said at least one folding jaw cylinder;

means for displacing said folding blade cylinder between a working position and a rest position, said folding blade cylinder working with said folding jaw cylinder only in said working position of said folding blade cylinder;

an intermediate space between said at least one folding jaw cylinder and said folding blade cylinder when said folding blade cylinder is in said rest position; and a folded signature guidance system positionable in said intermediate space only when said folding blade cylinder is in said rest position.

7. The following apparatus of claim 6 further including a second, stationary folding blade cylinder.

8. The folding apparatus of claim 6 further including pairs of folding jaws on said at least one folding jaw cylinder, each of said pairs of folding jaws acting with a separate folding blade cylinder.

9. The folding apparatus of claim 8 wherein each pair of folding jaws includes first and second folding jaws that are each displaceable circumferentially in said at least one folding jaw cylinder.

10. The folding apparatus of claim 6 wherein said folding blade cylinder includes a folding blade and a gripper, said folding blade and said gripper being displaceable circumferentially in said folding blade cylinder.

11. The folding apparatus of claim 6 wherein said means for displacing said folding blade cylinder includes plugs positionable between said folding blade cylinder and said at least one folding jaw cylinder.

12. The folding apparatus of claim 6 further including means for mechanically displacing said folding blade cylinder out of said working position in response to a voltage drop.

13. The folding apparatus of claim 6 further including drive motors in the folding apparatus, said drive motors acting as generators in response to a voltage drop and driving said folding blade cylinder synchronously with said at least one folding jaw cylinder.

14. A folding blade apparatus comprising:

at least one folding jaw cylinder;

a folding blade cylinder adapted to work together with said at least one folding jaw cylinder when said folding jaw cylinder is in a working position;

means for displacing said folding blade cylinder between said working position and a rest position in which said folding blade cylinder is moved away from said folding jaw cylinder; and means for mechanically moving said folding blade cylinder out of said working position and to said rest position in response to a sensed voltage drop in the folding blade apparatus.

15. The folding apparatus of claim 14 further including a second, stationary folding blade cylinder.

16. The folding apparatus of claim 14 further including pairs of folding jaws on said at least one folding jaw cylinder, each of said pairs of folding jaws acting with a separate folding blade cylinder.

17. The folding apparatus of claim 16 wherein each pair of folding jaws includes first and second folding jaws that are each displaceable circumferentially in said at least one folding jaw cylinder.

18. The folding apparatus of claim 14 wherein said folding blade cylinder includes a folding blade and a gripper, said folding blade and said gripper being displaceable circumferentially in said folding blade cylinder.

19. The folding apparatus of claim 14 wherein said means for displacing said folding blade cylinder includes plugs positionable between said folding blade cylinder and said at least one folding jaw cylinder.

20. The folding apparatus of claim 14 further including a belt guidance system adapted to take signatures from said at least one folding jaw cylinder, said belt guidance system being positionable between said at least one folding jaw cylinder and said folding blade cylinder in said rest position.

21. The folding apparatus of claim 14 further including drive motors in the folding apparatus, said drive motors acting as generators in response to a voltage drop and driving said folding blade cylinder synchronously with said at least one folding jaw cylinder.

22. A folding apparatus comprising:

at least one folding jaw cylinder;

a first folding blade cylinder;

a first electric motor, said first electric motor driving both said at least one folding jaw cylinder and said first folding blade cylinder;

a second folding blade cylinder; and a second electric motor driving said second folding blade cylinder, said second folding blade cylinder being driven by said second electric motor independently of said first folding blade cylinder.

23. The folding apparatus of claim 22 wherein both said first folding blade cylinder and said second folding blade cylinder are adapted to work with said at least one folding jaw cylinder.

24. The folding apparatus of claim 22 further including folding jaws defining an adjustable width folding jaw gap on said at least one folding jaw cylinder, said second electric motor driving said second folding blade cylinder for insertion of a folding blade on said second folding blade cylinder centered in said adjustable width folding jaw gap.

* * * * *